US007520447B2

(12) United States Patent
Engelen et al.

(10) Patent No.: US 7,520,447 B2
(45) Date of Patent: Apr. 21, 2009

(54) SPRAY BOTTLE

(75) Inventors: Wim Engelen, Vilvoorde (BE); Hugo Smid, Antwerpen (BE)

(73) Assignee: Monsanto Europe S.A. (BE)

( * ) Notice: Subject to any disclaimer, the term of this patent is extended or adjusted under 35 U.S.C. 154(b) by 381 days.

(21) Appl. No.: 10/530,593

(22) PCT Filed: Oct. 6, 2003

(86) PCT No.: PCT/EP03/11018

§ 371 (c)(1),
(2), (4) Date: May 18, 2005

(87) PCT Pub. No.: WO2004/033109

PCT Pub. Date: Apr. 22, 2004

(65) Prior Publication Data

US 2006/0016910 A1 Jan. 26, 2006

(30) Foreign Application Priority Data

Oct. 10, 2002 (EP) ..... 02022655
Dec. 16, 2002 (EP) ..... 02028236

(51) Int. Cl.

| | |
|---|---|
| ***A62C 13/62*** | (2006.01) |
| *B05B 1/10* | (2006.01) |
| *B67D 5/65* | (2006.01) |
| *B65D 1/02* | (2006.01) |
| *A46B 5/02* | (2006.01) |

(52) U.S. Cl. ..... 239/302; 239/284.1; 239/366; 239/525; 239/526; 222/175; 222/464.7; 222/416; 222/469; 222/383.1; 222/377; 222/331; 222/323; 222/324; 215/40; 215/41; 215/42; 215/43; 215/44; 215/45; 215/46; 215/47; 215/48; 215/49; 215/50; 215/51; 215/52; 215/53; 215/54; 215/55; 401/6; 401/7; 401/8

(58) Field of Classification Search ..... 239/302, 239/284.1, 366, 525, 526; 222/175, 464.7, 222/416, 469, 383.1, 377, 331, 323, 324; 215/40–55; 401/6, 7, 8
See application file for complete search history.

(56) References Cited

U.S. PATENT DOCUMENTS

| | | | | | |
|---|---|---|---|---|---|
| 2,423,220 | A | * | 7/1947 | Arpin | 222/79 |
| 3,814,292 | A | * | 6/1974 | Dargols | 222/190 |
| 4,257,460 | A | * | 3/1981 | Paranay et al. | 141/26 |
| 4,355,739 | A | * | 10/1982 | Vierkotter | 222/134 |
| 4,784,293 | A | * | 11/1988 | Hiroshi | 222/79 |
| 4,830,235 | A | * | 5/1989 | Miller | 222/464.4 |
| 5,160,071 | A | * | 11/1992 | Wright | 222/324 |
| 5,195,664 | A | * | 3/1993 | Rhea | 222/464.4 |
| 5,361,946 | A | * | 11/1994 | Ginther et al. | 222/175 |
| 5,366,108 | A | * | 11/1994 | Darling | 222/1 |
| 5,381,961 | A | * | 1/1995 | Evans et al. | 239/333 |
| 5,398,846 | A | * | 3/1995 | Corba et al. | 222/1 |
| 5,413,251 | A | * | 5/1995 | Adamson | 222/129 |
| 5,433,347 | A | * | 7/1995 | Richter et al. | 222/105 |
| 5,472,119 | A | * | 12/1995 | Park et al. | 222/145.8 |
| 5,730,335 | A | * | 3/1998 | Maas et al. | 222/341 |
| 5,799,827 | A | * | 9/1998 | D'Andrade | 222/79 |
| 5,819,987 | A | * | 10/1998 | Miller | 222/135 |
| 5,865,344 | A | * | 2/1999 | Nagel | 222/79 |
| 6,006,768 | A | * | 12/1999 | Cox | 134/200 |
| 6,213,358 | B1 | * | 4/2001 | Libit et al. | 222/633 |
| 6,234,347 | B1 | * | 5/2001 | Amron | 222/1 |
| 6,264,073 | B1 | * | 7/2001 | Good et al. | 222/464.4 |
| 6,547,105 | B1 | | 4/2003 | Seelhofer et al. | 222/205 |
| 2003/0038186 | A1 | * | 2/2003 | Klima et al. | 239/333 |
| 2005/0167527 | A1 | * | 8/2005 | Iiood et al. | 239/302 |

FOREIGN PATENT DOCUMENTS

| | | | | |
|---|---|---|---|---|
| DE | EP1035034 | | * | 9/2000 |
| DK | DE 197 42 464 | A | | 4/1999 |
| DK | DE 202 01 532 | U | | 4/2002 |
| EP | 1035034 | A1 | * | 9/2000 |
| FR | 2 711 305 | A | | 4/1995 |
| FR | 2711305 | A1 | * | 4/1995 |
| FR | 2711305 | | * | 5/2000 |
| GB | EP 1 035 034 | A | | 9/2000 |
| WO | WO0076876 | | * | 12/2000 |
| WO | WO 0076876 | A1 | * | 12/2000 |

* cited by examiner

*Primary Examiner*—Len Tran
*Assistant Examiner*—Steven Cernoch
(74) *Attorney, Agent, or Firm*—Howrey LLP

(57) ABSTRACT

The current invention relates to a dispenser comprising a container (A) for holding a product to be dispensed and a dispensing mechanism (B), said dispenser comprises i. a container body (Q) having a bottom (E), and a means for interconnecting said bottom with a side opposite thereto; said container body further including at least one outlet opening (F) arranged in or near the side opposite to said bottom, preferably in or near the upper half of the means interconnecting the bottom with the side opposite to said bottom, ii. a conduct (G) connecting said container body, extending from the outlet opening (F), with said dispensing mechanism, iii. a trigger sprayer (H) and, iv. a neck (K) connecting said trigger sprayer (H) with said conduct (G) wherein said neck (K) and said conduct (G) are linked to said container body (Q) so that said neck (K) and said conduct (G) form a swan-neck or a U-shape extending from said outlet opening (F) so as to exchange air pressure and product to be dispensed.

18 Claims, 15 Drawing Sheets

SPRAY BOTTLE

This application is a §371 U.S. national stage filing of international application PCT/EP03/11018, filed 6 Oct. 2003 (published in English on 22 Apr. 2004 as WO 2004/033109) and claiming priority to EP 02028236.4 filed 16 Dec. 2002 and EP 02022655.1 filed 10 Oct. 2002.

The present invention relates to a dispenser comprising a container for holding a product to be dispensed and a dispensing mechanism.

Dispensers are generally well known in the art. Prior art dispensers of the general type typically include a bottle having a neck at the top, and a dispensing mechanism, for instance a trigger sprayer, attached to the neck. The trigger sprayer may be attached to the bottle in any conventional way, e.g. by a threaded connection, a bayonet connection or a snap connection. Such trigger sprayers are well known in the art.

Alternatively, part of the trigger sprayer may form a single part or element with the bottle.

A problem with dispensers known in the art comprising a container for holding a product to be dispensed is that those containers, when (completely) filled, are mostly uncomfortable as a result of the weight of the liquid contained therein. The filled dispenser as such therefore can sometimes be heavy and difficult or uncomfortable in its use.

Known dispensers with the dispensing mechanism attached at the top of the container, mostly threaded thereto, have the disadvantage that the wrist and/or forearm of the user are heavily loaded and/or stressed. In using those known dispensers the wrist has to move up and down in addition to inward and outward movement of the wrist. It is clear that such movements can lead to medical problems at the wrist and/or forearm of the user of such dispensers.

In addition known dispensers as described here above have the disadvantage that when emptied, there often remains a significant leftover of liquid in the bottle. It is practically impossible to completely empty the container of known dispensers. This problem could be solved by reducing the bottom surface of the container. Doing so, however, causes new difficulties with respect to storage of the relevant dispensers in upright position.

Dispensers known in the art must normally be used in an upright position. When inclined, e.g. when spraying onto the soil, leakage problems along the trigger sprayer often occur through the venting system of the sprayer. So dispensers known in the art cannot conveniently be used under an inclination, especially in an inclination such that the dispensers are directed towards the soil surface.

The invention now seeks to solve the technical problems mentioned here above and seeks to overcome the above-mentioned drawbacks.

The current invention thus relates to a dispenser comprising a container for holding a product to be dispensed and a dispensing mechanism, wherein the container is connected to the dispensing mechanism by way of a siphon.

For the understanding of the word siphon, reference is made to the meaning of siphon as the device used in sanitary equipment, like sinks, showers, etc., which allows for discharge of liquid while preventing transfer of gas, like air.

The advantage of the invention dispenser resides in the fact that the relevant dispenser can easily be inclined in use without showing leakage of product through the dispensing mechanism, since an air bubble separates the volume of liquid to be dispensed from the venting system of the dispensing mechanism, such as for instance a trigger sprayer.

In one preferred embodiment, the siphon comprises a U-shape, also called swan-neck. In that case, the dispenser comprises a) a conduct connecting a container body, extending from the outlet opening, with said dispensing mechanism, b) a trigger sprayer and, c) a neck connecting said trigger sprayer with said conduct wherein said neck and said conduct are linked to said container body so that said neck and said conduct form a swan-neck or a U-shape extending from said outlet opening so as to exchange air pressure and product to be dispensed.

In addition to the above referenced advantage, the dispenser according to this embodiment can be designed in such a way that the heavy part of the container rests on the user's forearm when in use, hence reducing the stress applied thereto.

The means for interconnecting the bottom of the container body and the side opposite thereto can be either a cylinder, like a bottle, or have a cubical shape wherein this cubic form comprises side walls, preferably at least 4 side walls (C,D, . . . ) interconnecting the bottom with the side opposite thereto. Alternatively the container body can have a triangular form.

In a preferred embodiment, the invention dispenser has a protrusion arranged close to the trigger sprayer such as to receive the end of a dip tube attached to said trigger sprayer.

In another preferred embodiment, the invention dispenser has the said protrusion arranged in such a manner as to extend the conduct and to receive the dip tube which is attached to the sprayer.

In yet another embodiment, the dispenser has the protrusion arranged in a manner extending the neck so as to receive the dip tube attached to the sprayer.

Alternatively, the dispenser according to the invention has the protrusion arranged in the neck in such a manner as to receive the dip tube attached to the sprayer.

As a result of this design, the liquid left over after emptying is significantly reduced.

In order to overcome the disadvantages, such as stressed wrist and/or forearm, associated with the use of known sprayers which are mostly rather heavy, the dispenser according to the current invention is advantageously shaped in such a manner that the container body is resting on the forearm of the user of said dispenser. More in particular, the sidewall of said container body is shaped in such a manner that said sidewall is resting on the forearm of a human being when in use.

For ease of filling the dispenser with liquid, the protrusion may contain an opening means with closure means, so that the sprayer does not have to be removed from the neck of the dispenser. Alternatively, the dispenser according to the invention comprises an opening for filling, in its bottom and/or in one or more of its sidewalls and/or in its side opposite to said bottom.

The trigger sprayer can be selected from trigger sprayers known in the art and is attached to the neck in any conventional way e.g; by a threaded connection, a bayonet connection or a snap connection. However the trigger sprayer can also be glued or integrated within the neck and hence form one single element with it.

The combined elements, trigger sprayer, neck and conduct, can also be fastened to the container body at the outlet opening in any conventional way e.g; by way of a threaded connection, a bayonet connection or a snap connection, and may alternatively be integrated as to form one part with the container body.

According to another embodiment of the invention, the container body is connected to the external chamber of a coaxial siphon, and the internal chamber of said coaxial siphon bears the trigger sprayer. The dip tube of the trigger sprayer is lodged in the internal chamber of the coaxial siphon, extending into the external chamber of said siphon.

Preferably, the internal chamber of said coaxial siphon is inclined by 10° to 45°, preferably 15°-30°, versus the sprayer axis perpendicular to the longitudinal spray axis, away from the container body.

The external chamber of the coaxial siphon may advantageously be shaped in the form of a hand grip and the container body may then be designed ergonomically so as to rest on the user's arm when in use. The embodiment as herein described allows for the design of very handy and comfortable dispensers.

Although it is not essential for the performance of the current invention, suitable trigger sprayers are for instance trigger sprayers with a so-called precompression system. A precompression system may be placed between a pump and a discharge nozzle that are connected by a conduit debauching in a space, the system comprising a precompression valve movable between a position closing off the connection in which it abuts a seat on the mouth of the conduit and a position releasing the connection in which it is spaced from the seat, the precompression valve being biased to the closing position by spring means. Such a precompression system is known from e.g. U.S. Pat. No. 5,730,335 or WO 00/33970. Other trigger sprayers suitable for use on the invention dispenser are those described in e.g. U.S. Pat. Nos. 4,706,888 and 6,126,090.

There are several advantages connected with the use of the invention dispensers having a container body shaped according to the present invention.

Firstly there are ergonomic advantages. For the handgrip itself, there is a better grasping interface for left as well as right-handed users. There is no need for up and down movement of the wrist (so called radial and ulnar deviation) and in addition only limited outward and inward movement of the wrist are necessary (so called dorsiflexion and palmar flexion of the wrist) and allowed to properly use or spray the product contained in the dispenser. The working line of the spray liquid (the spraying action) is the normal working line of the wrist-arm alignment. The wrist alignment is achieved because of the geometric layout of the container or bottle according to the current invention. Another advantage due to the container in accordance with the invention is that the weight of said container, when filled, does not stress the wrist resulting in a much better comfort of use. The forearm supports the weight without bending the wrist. The weight of a known container or bottle forces the wrist to misalign with the arm.

Secondly there are environmental advantages in using the dispenser according to the present invention. As will be apparent in the detailed description herein below, the dip tube attached to the sprayer usually extends into a protrusion or a chamber designed in such a way that there is a minimal left-over of liquid in the container. There is only a very little volume left around the end of the dip tube.

Thirdly the dispenser according to the present invention is safer with regard to leakage of liquid out of the container. With a normal classical fill as manufactured, the risk of leaking of the inventive dispenser is much smaller compared to the dispensers known in the art. If the inventive dispenser falls over on its left or right side, the risk of leaking is reduced by 50%, because the liquid hardly ever reaches the venting system of the trigger sprayer thanks to the presence of the air chamber. Liquid present in a known dispenser always contacts the dispensing mechanism when falling on its left or right side or when used in inclined position, resulting in sometimes substantial leakage of the liquid.

A standard trigger sprayer present on a known spray bottle cannot conveniently be used under an inclination when the bottle is directed to the soil surface, for instance for spraying herbicides or spraying household cleaners, since it will start leaking after several, say approximately five (5), trigger actions or when the trigger is continuously armed. This is because of the 'venting system' present in the trigger sprayer. The dispenser according to the current invention causes essentially no leakage because the air bubble prevents the liquid from flowing through the venting hole.

Information relating to the product contained in the bottle and/or to the way the dispensing mechanism can be operated is usually displayed on labels that are applied on the side walls of the bottle or container. Therefore, to view this information, a prospective purchaser and/or user of the dispenser must hold the bottle up so high that the information on the labels on the sides of the bottle is visible.

In addition, purchasers of this type of dispensers usually store them in their homes in locations where they are easily accessed when needed. The dispensers are often stored in a cabinet beneath the sink of the home along with other cleaning and related products that are contained in bottles or dispensers, often bottles with trigger sprayers. When looking for a particular product contained in a bottle or dispenser that is stored beneath a sink, the user is often required to pick up each of the bottles and dispensers stored there to view the sides of the bottles and dispensers in order to determine their contents. Incidentally, the same issue arises when bottles or dispensers are tightly packed in display racks in supermarkets, where a prospective purchaser will often have to pick up a bottle or dispenser in order to verify if it is the particular brand which he/she is looking for.

The dispenser of the present invention overcomes these drawbacks associated with prior art dispensers. This is achieved by applying at least one label displaying information, on the sprayer head. With the information displayed on the dispensing mechanism, which is arranged on top of the bottle, it is not necessary to hold the dispenser up high in order to view the information. In this connection, the term "label" is intended to denote any object that is suitable for displaying information.

In a preferred embodiment of the dispenser, the dispensing mechanism includes at least one top surface, the at least one label being arranged on the top surface. The information, which may include information on how to operate the dispensing mechanism or on how to use the relevant product, is then readily visible when the dispenser is held in the hand prior to or during its use. In order to improve the impact and visibility of the information, the at least one label preferably displays the information in at least two different colors.

The invention will now be illustrated with reference to the annexed drawings in which like parts are identified by the same reference numerals:

Figure 9:
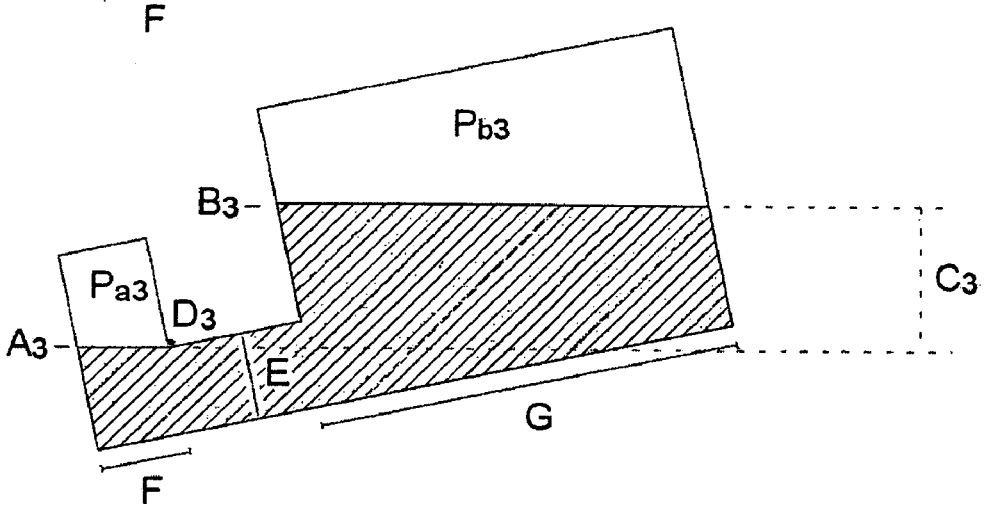
Figure 10:
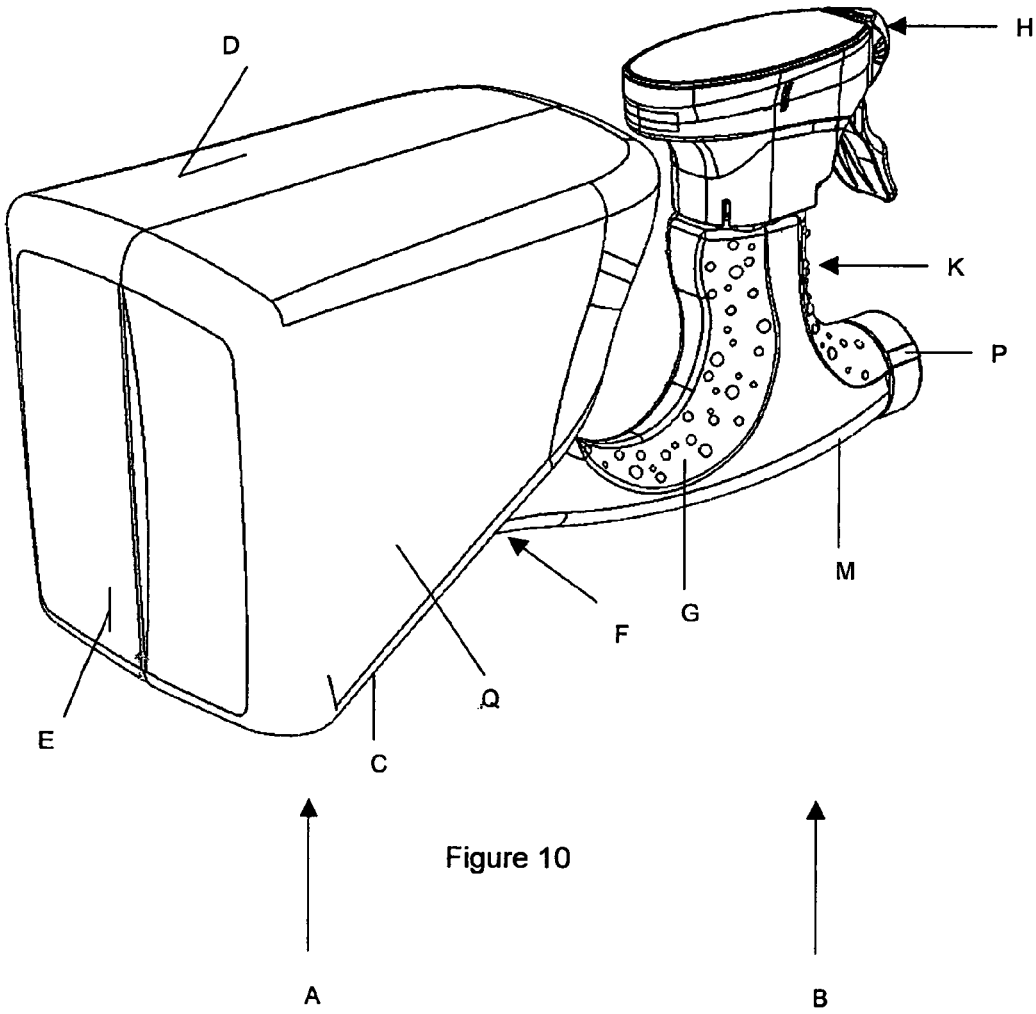
Figure 11:
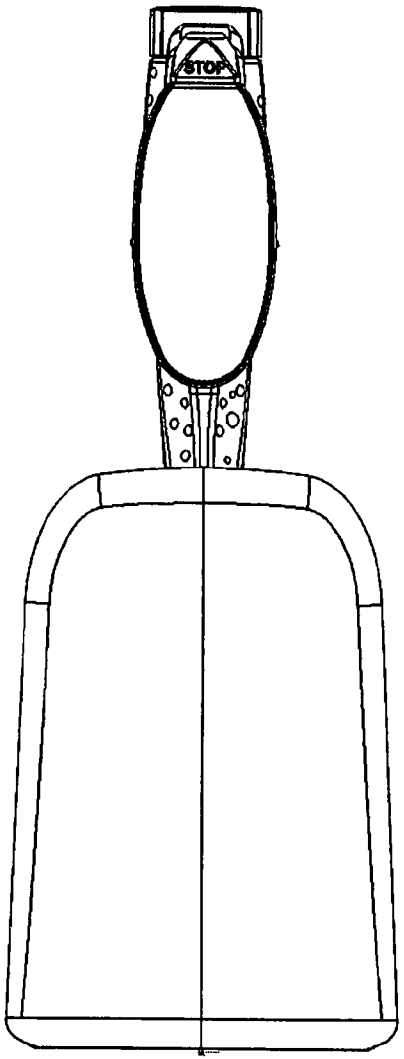
Figure 12:
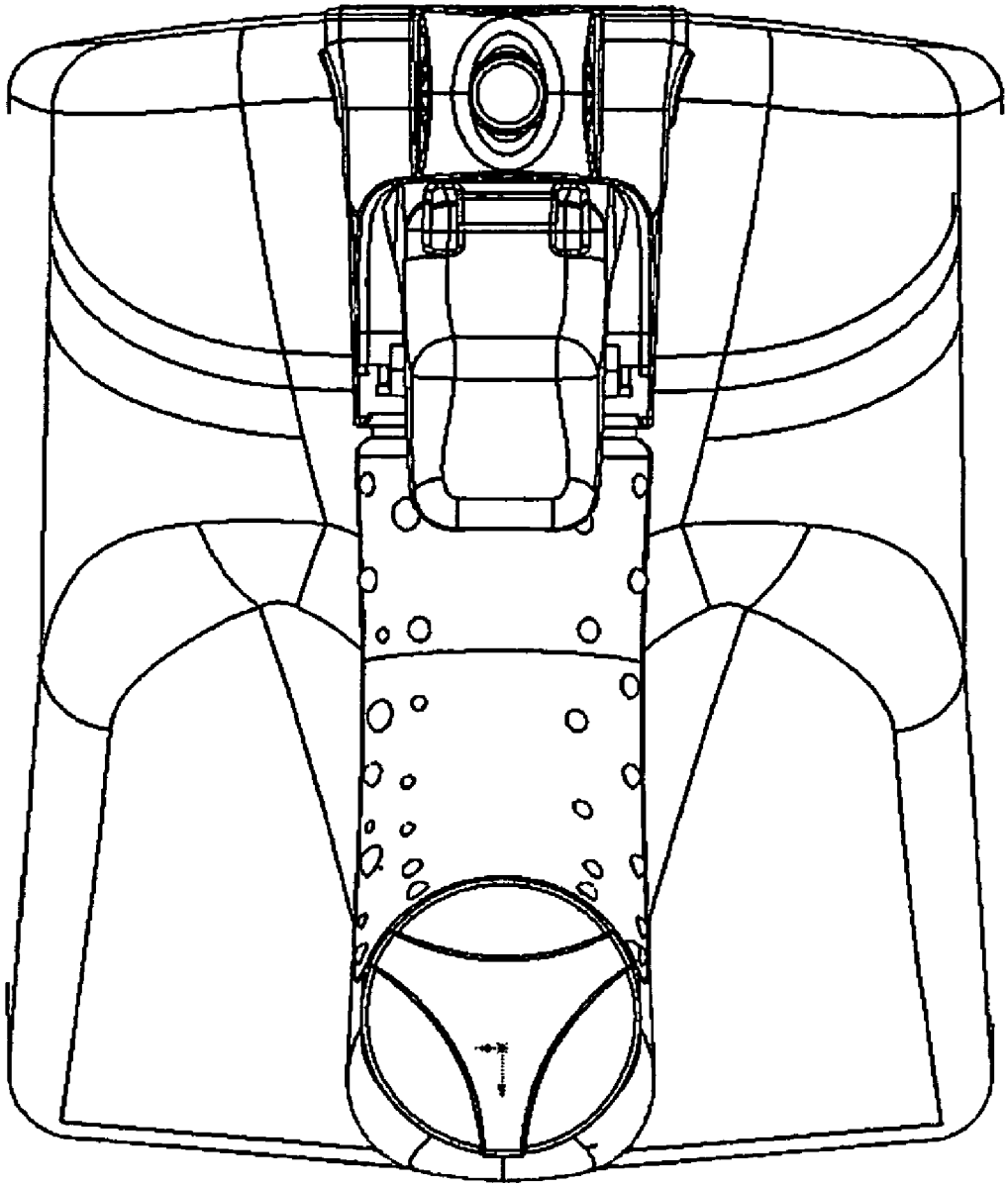
Figure 13:
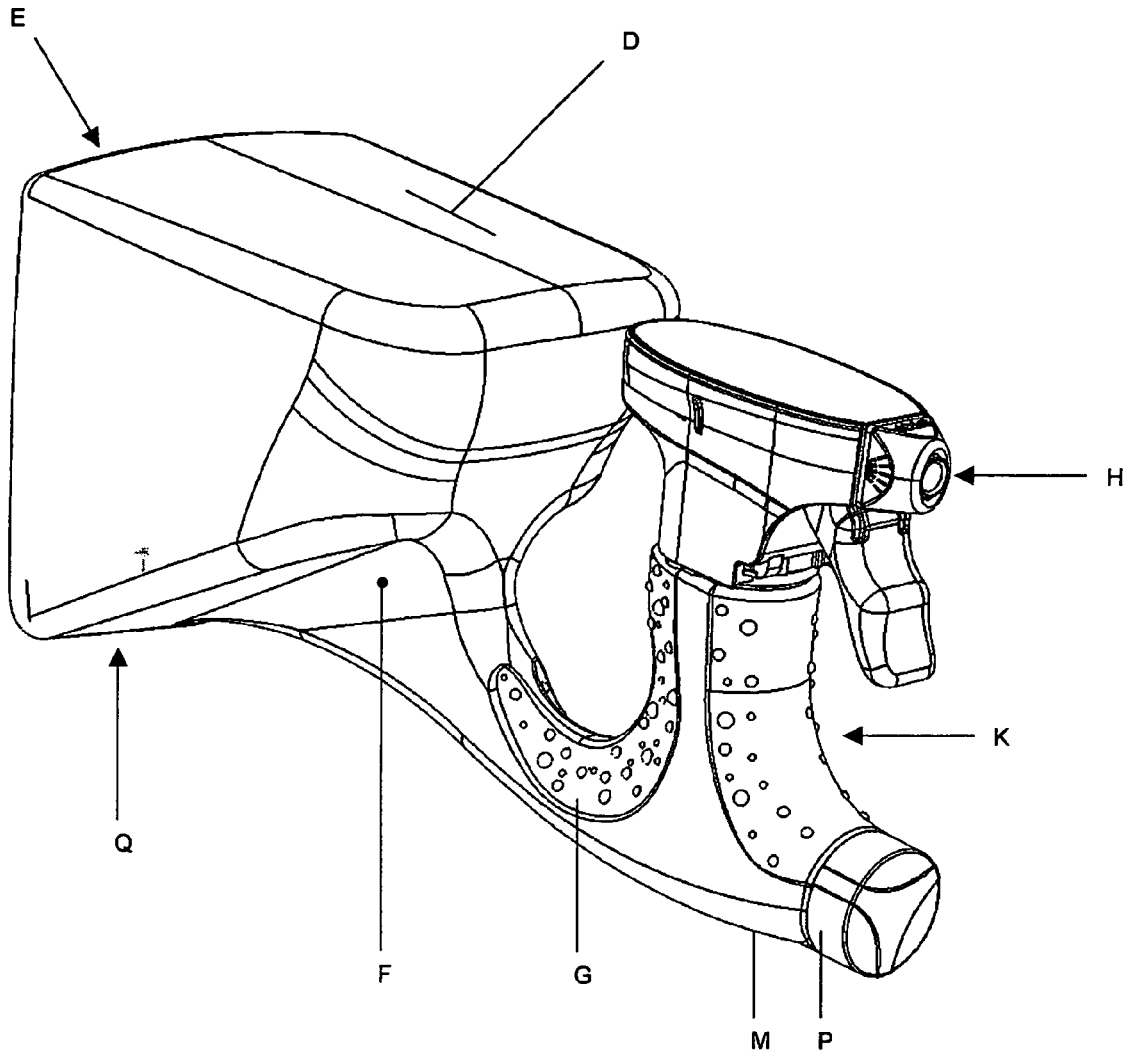
Figure 14:
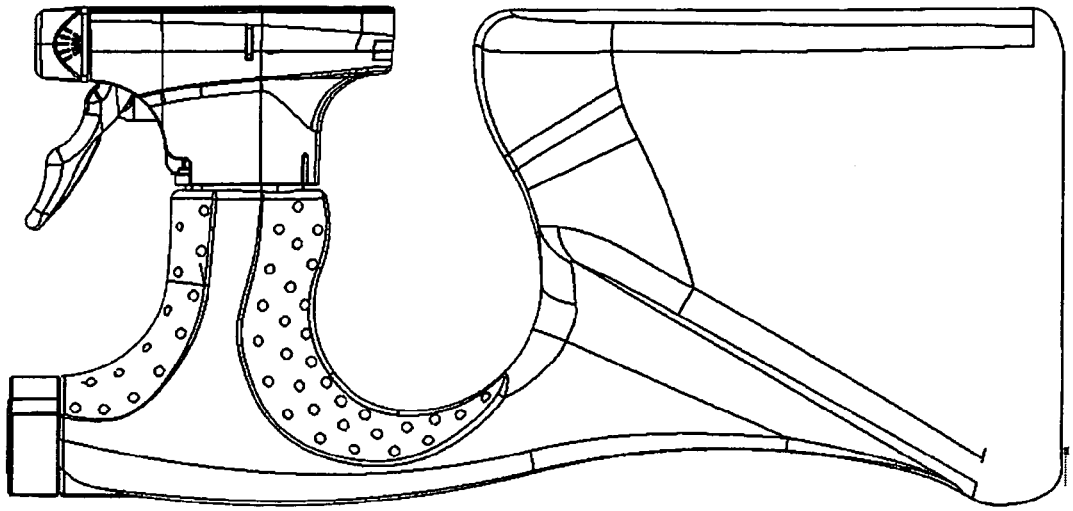
Figure 15:
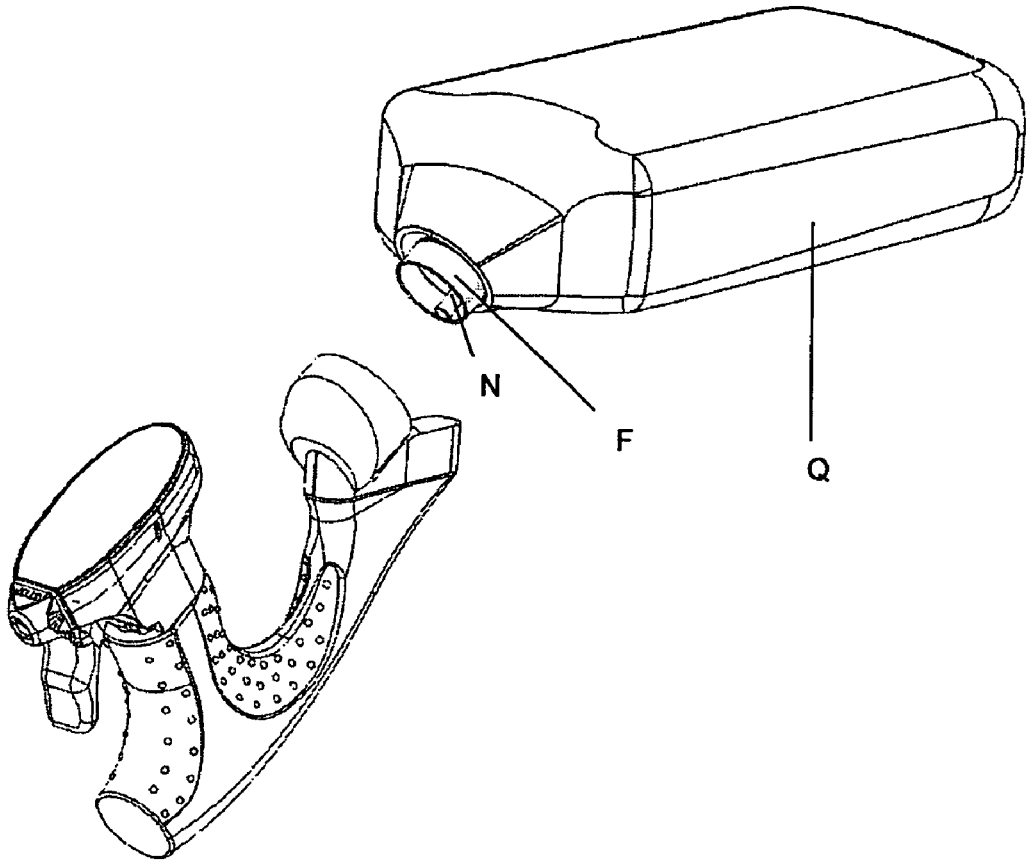
Figure 16:
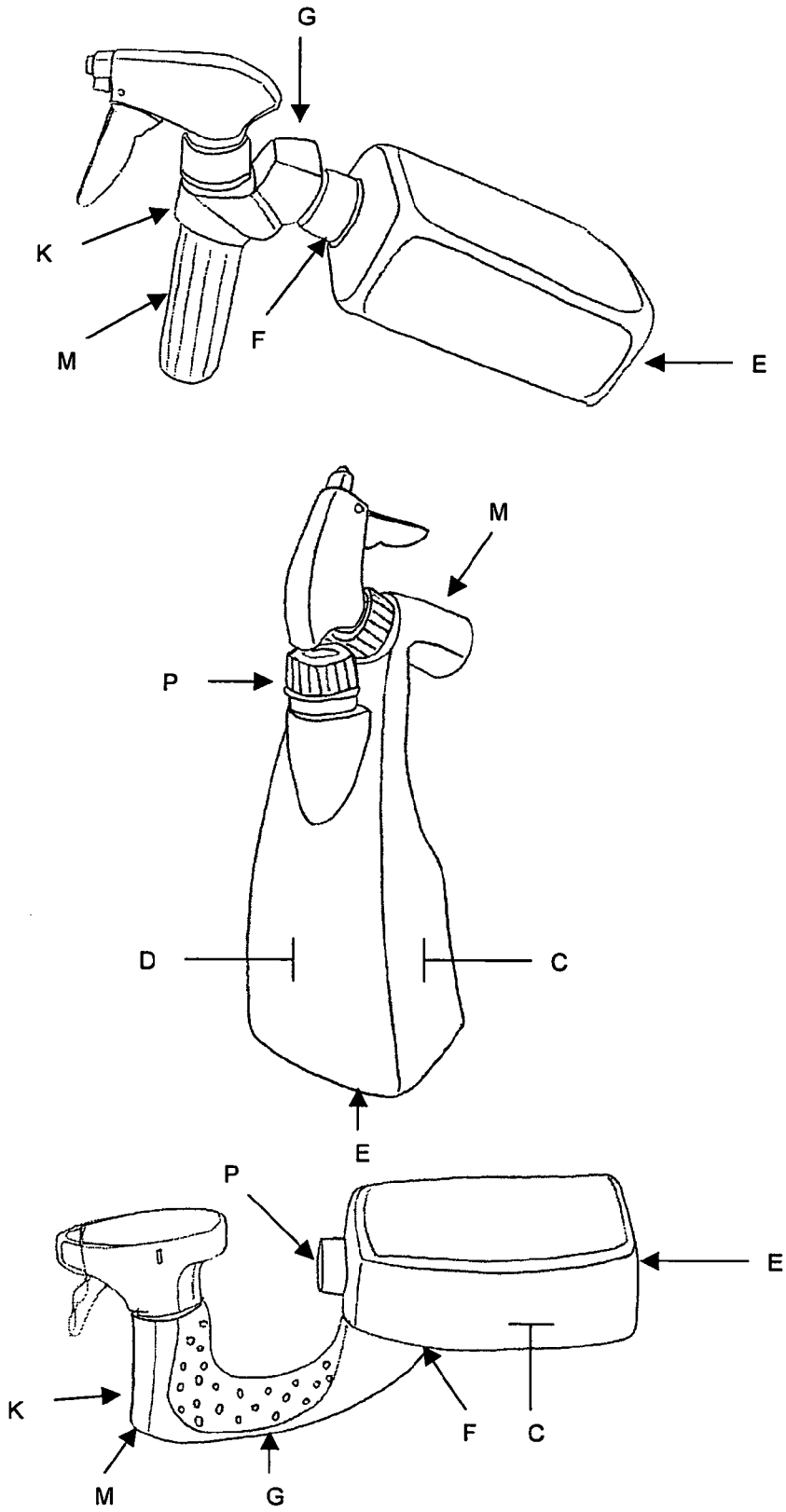
Figure 17:
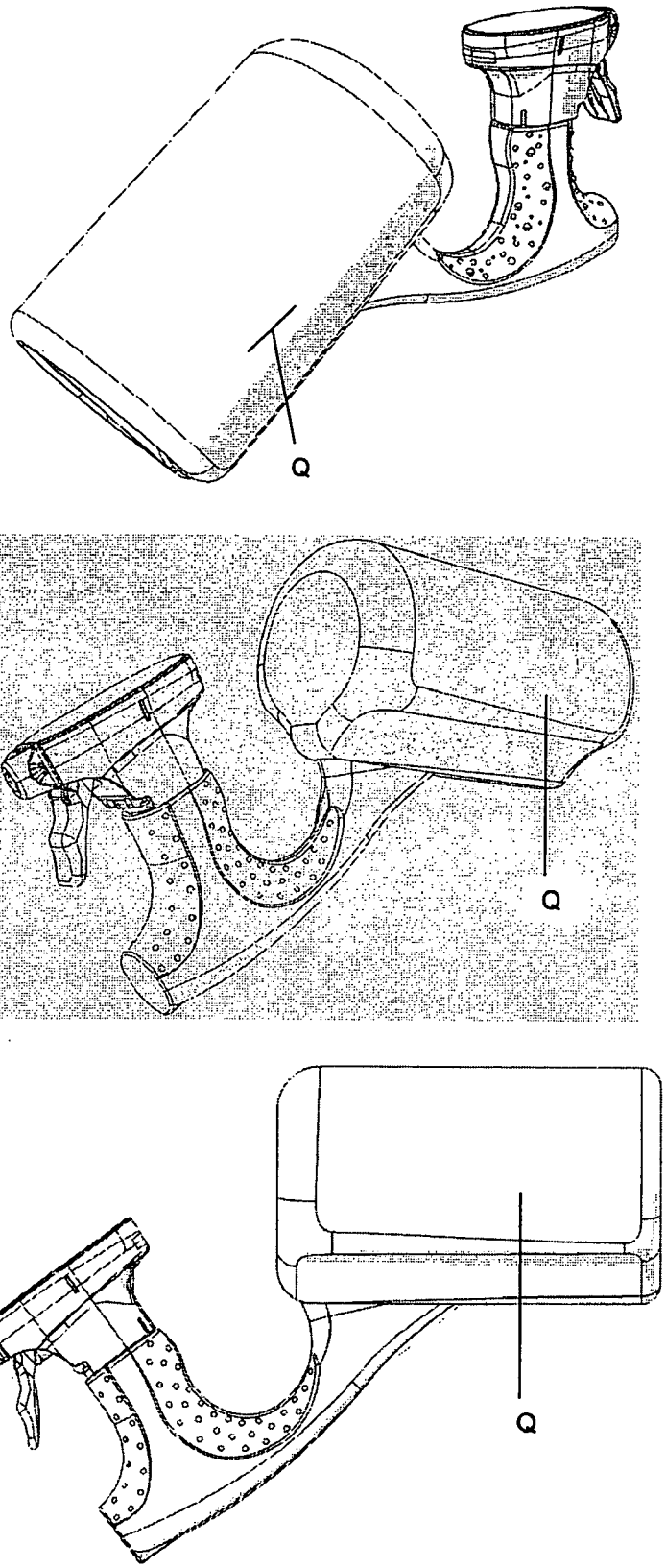
Figure 18:
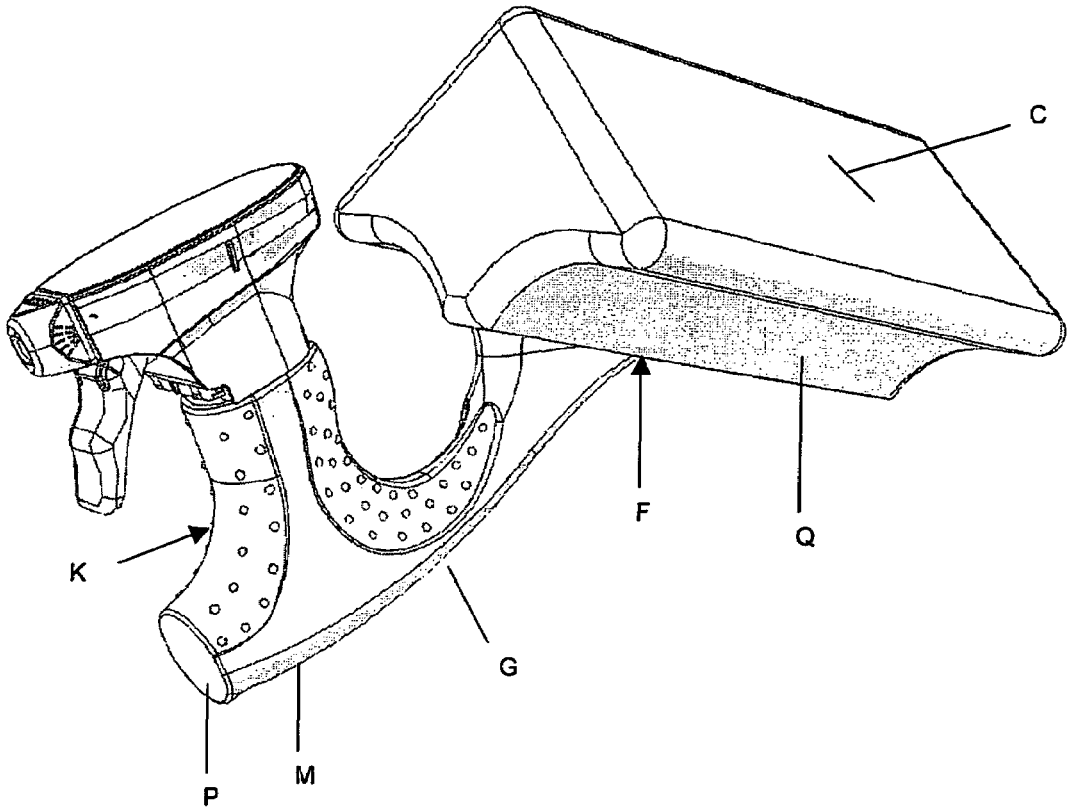
Figure 19:
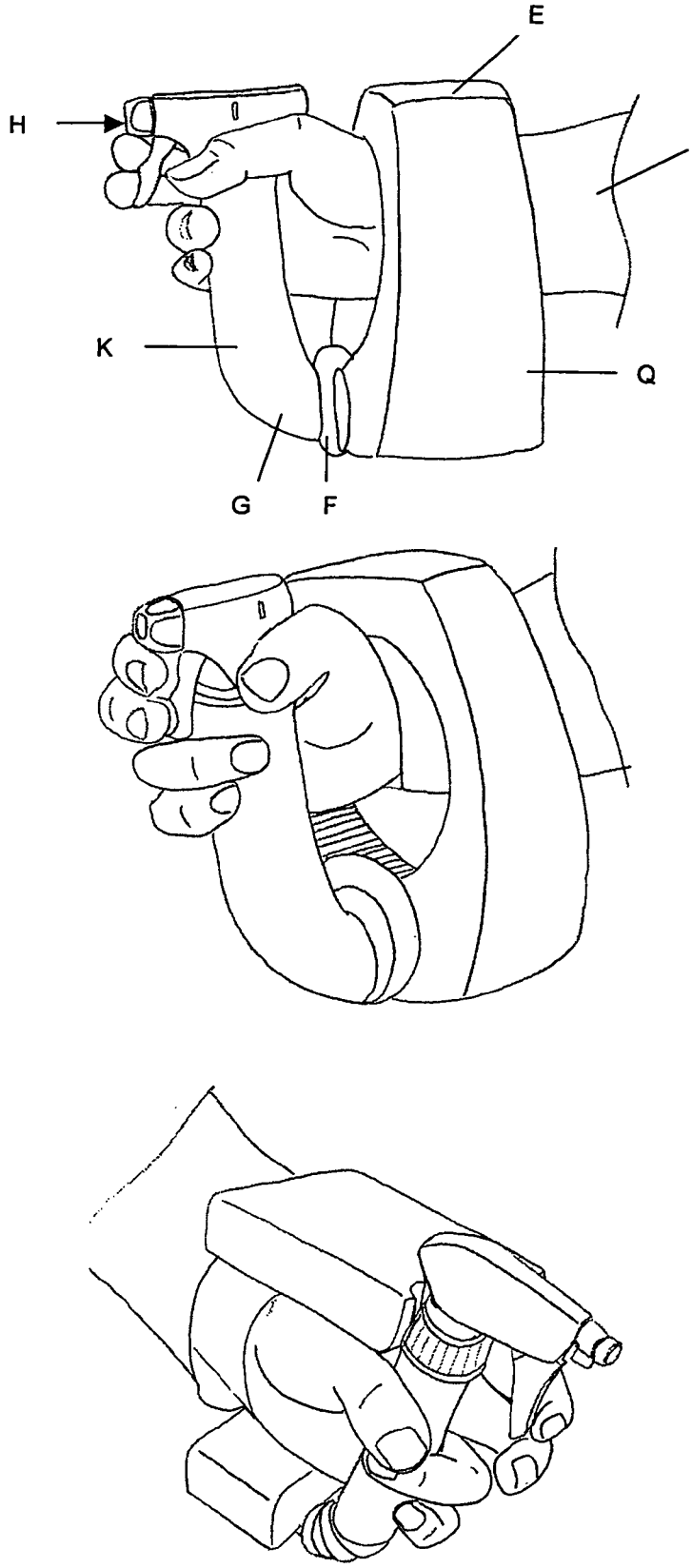
Figure 20:
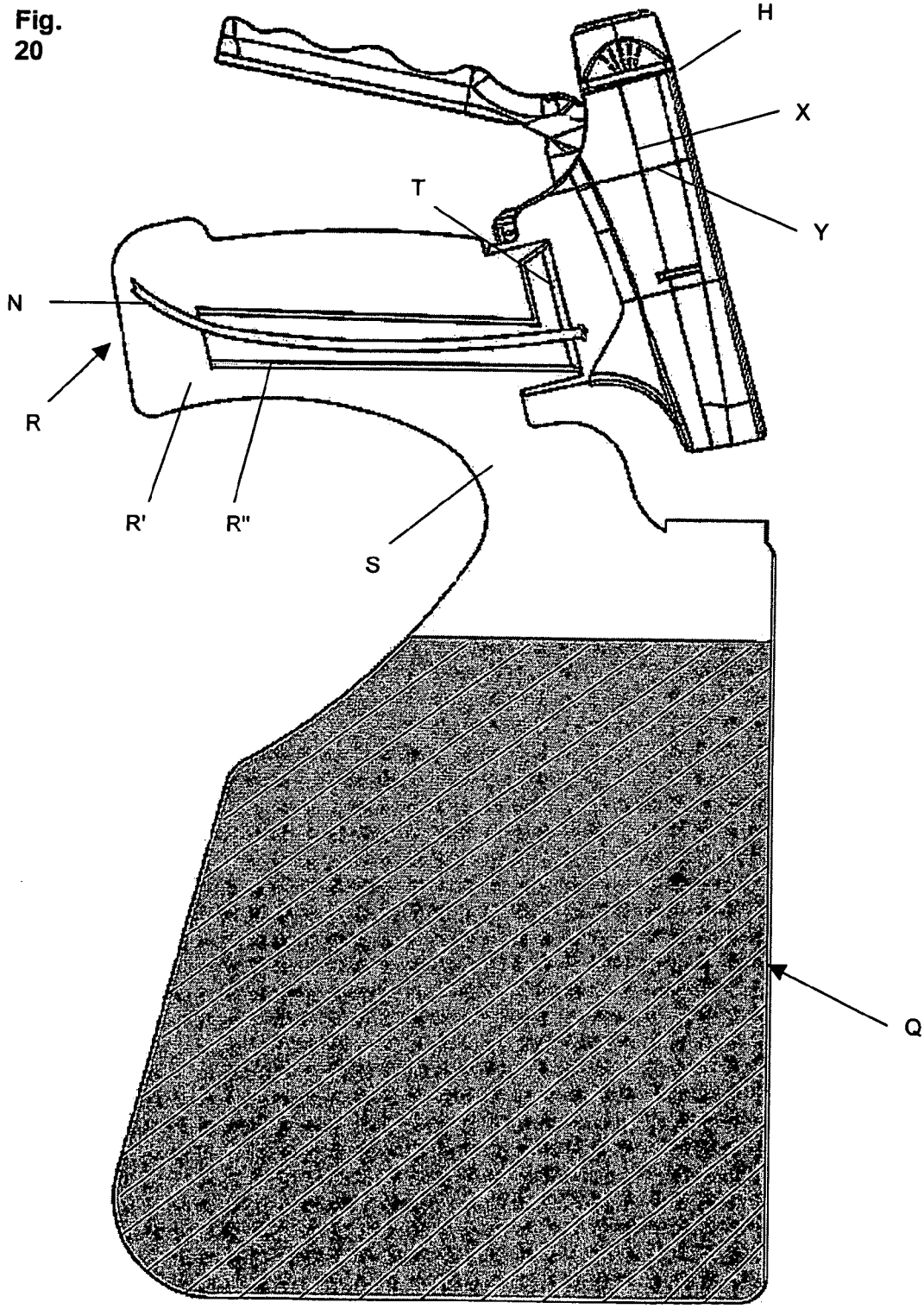
Figure 21:
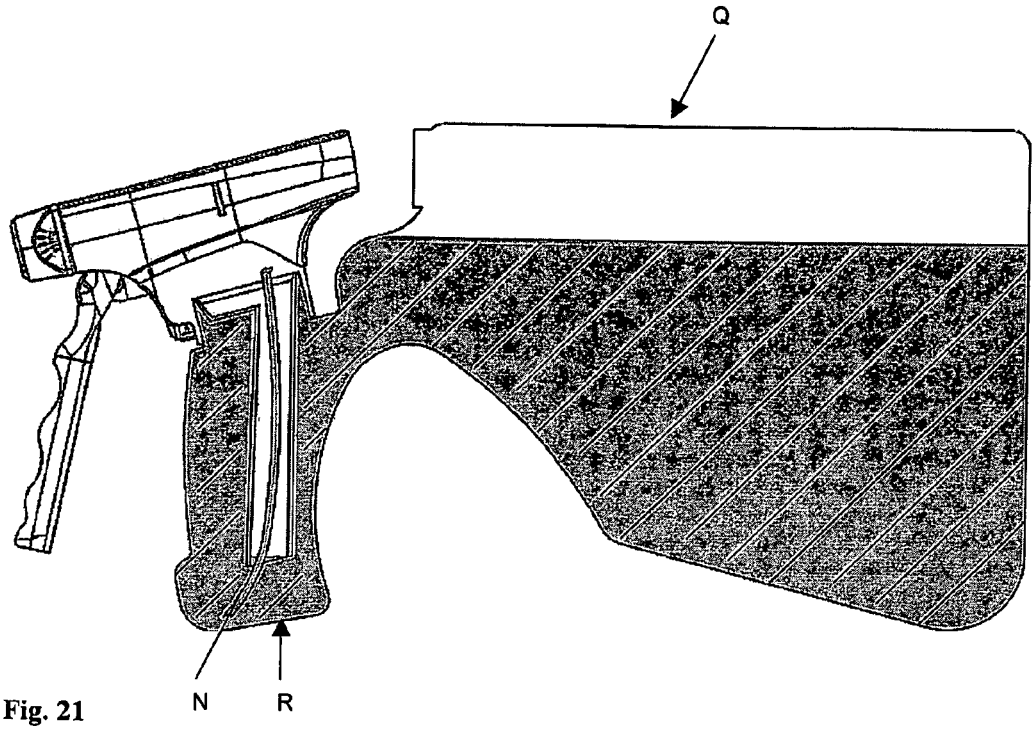
Figure 22:
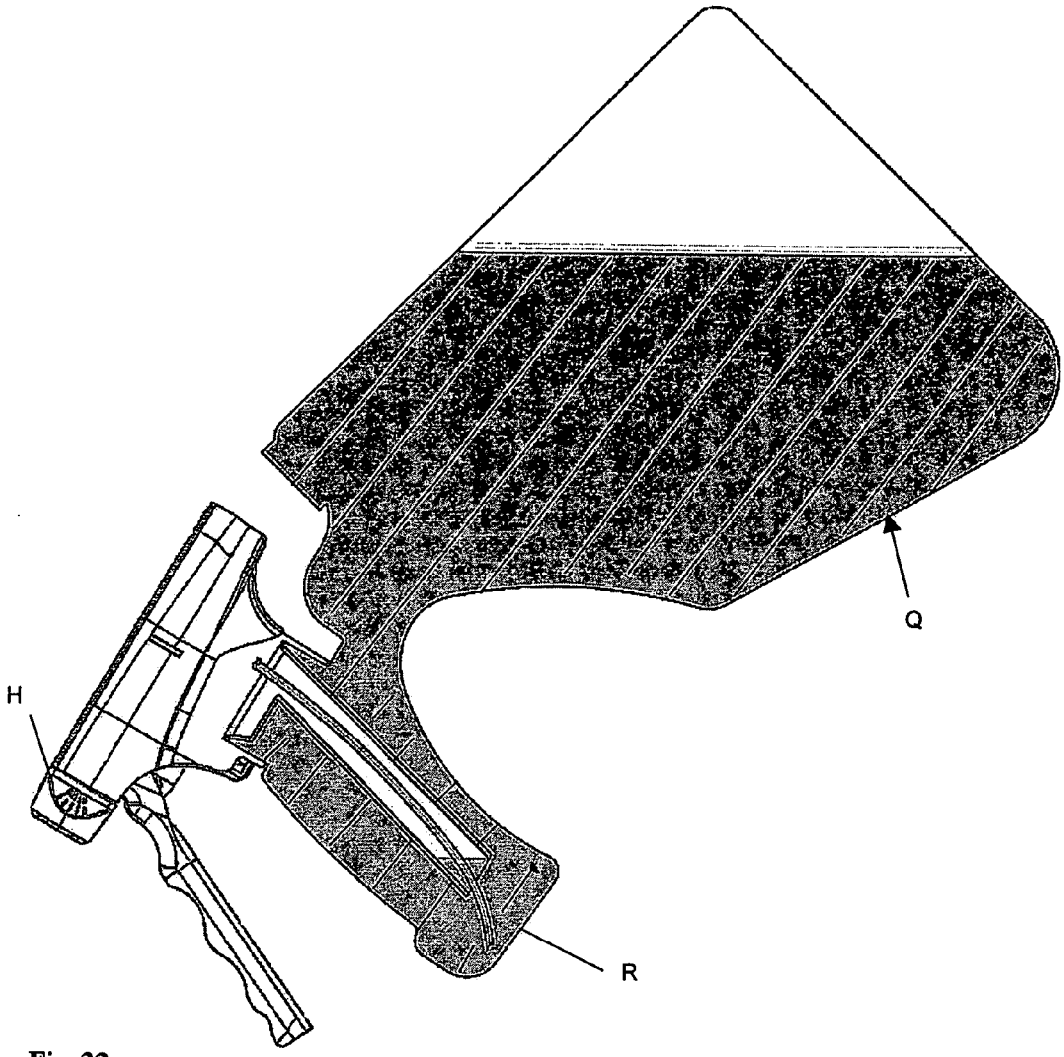

FIG. 9 the position of the bottle resting on the forearm during triggering and after triggering has stopped;

FIG. 10 shows a perspective view of a preferred embodiment;

FIG. 11 is a top view of a preferred embodiment;

FIG. 12 is a front view of a preferred embodiment;

FIG. 13 is a perspective view of a preferred embodiment;

FIG. 14 is a side view of a preferred embodiment;

FIG. 15 shows an alternative design;

FIGS. 16A, B and C show three alternative designs according to the invention;

FIGS. 17A, B and C show the inventive dispenser with a cylindrical container body;

FIG. 18 represents a dispenser according to the invention wherein the container body has a triangular form;

FIGS. 19A, B and C are different views of an alternative dispenser according to the invention; and FIGS. 20 to 22 show three different positions of yet another preferred embodiment of the invention.

EXPLANATION OF THE FIGS. 1 TO 6

These figures show how the two air chambers (A and B) move while rotating the bottle.

FIGS. 2 to 6 show the spraying positions.

While spraying the air pressure in chamber B will drop because of liquid going out of the bottle. Chamber A will stay at atmosphere pressure.

When the pressure in chamber B becomes too low (under pressure), air and pressure from chamber A is automatically transferred to chamber B and liquid flows to the dispensing mechanism. At the same time, while triggering, chamber A will be filled with air again by venting.

Venting is air exchange between outside and inside air and is happening while trigger is activated.

Figure 1:
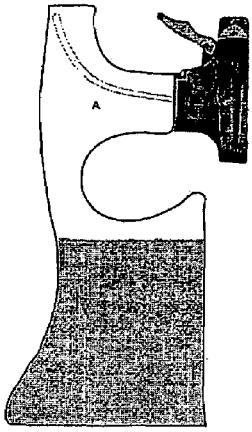
FIG. 1 is a schematic view of the invention dispenser in an upright position.
Figure 2:
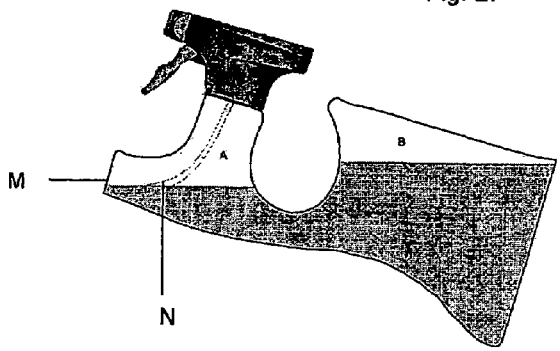
FIGS. 2-6 show different positions of the invention dispenser.
Figure 3:
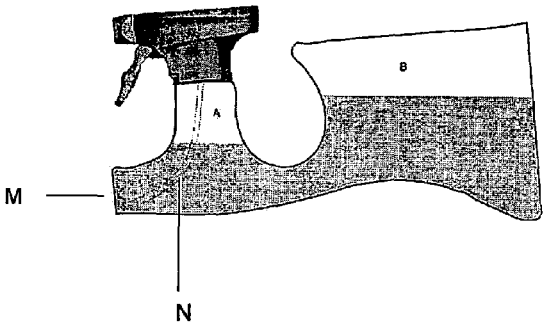
Figure 4:
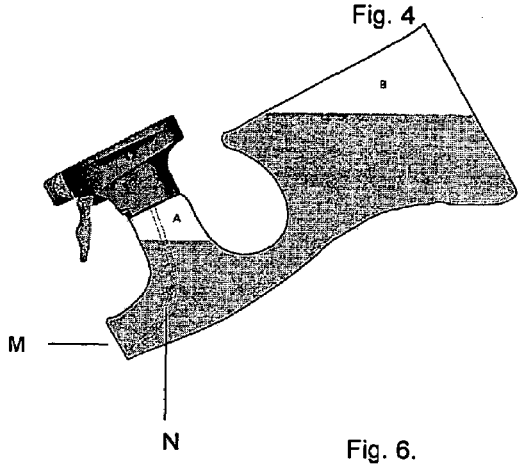
Figure 5:
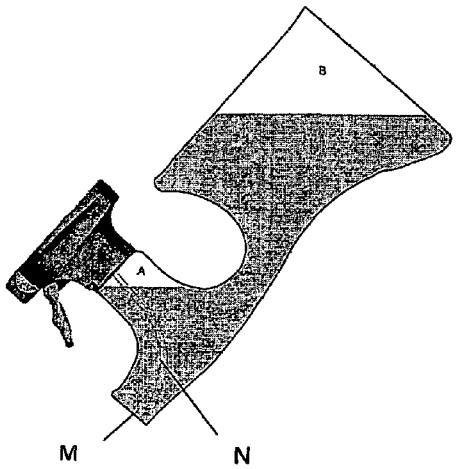
Figure 6:
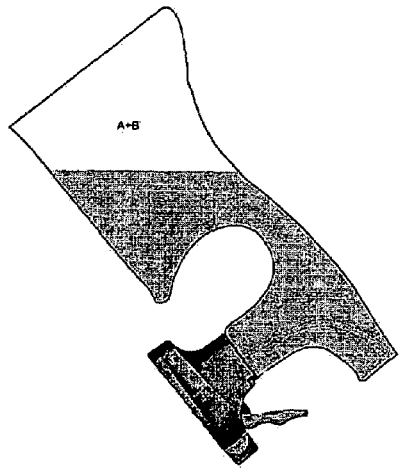
Figure 7:
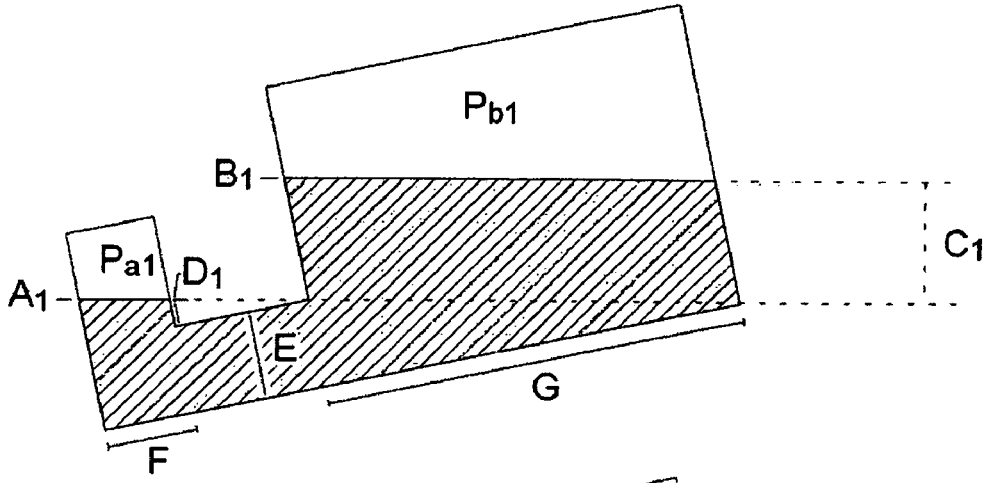
FIG. 7 shows the position of the bottle resting on the forearm before the trigger is activated.

FIG. 7 shows the bottle positioned on the forearm before the trigger is activated.

[similar to positions in FIGS. 2 to 5, without trigger being activated]

Under these conditions, the pressure in Pa1 is equal to the pressure in Pb1 plus the hydrostatic pressure (Ph) from liquid level difference C1. Pb1 is at atmospheric pressure.

Formula:

$$Pa1=Pb1+Ph(C1)$$

As a result, the liquid level A1 is in balance with liquid level B1, determined by the respective air chambers Pa1 and Pb1.

Figure 8:
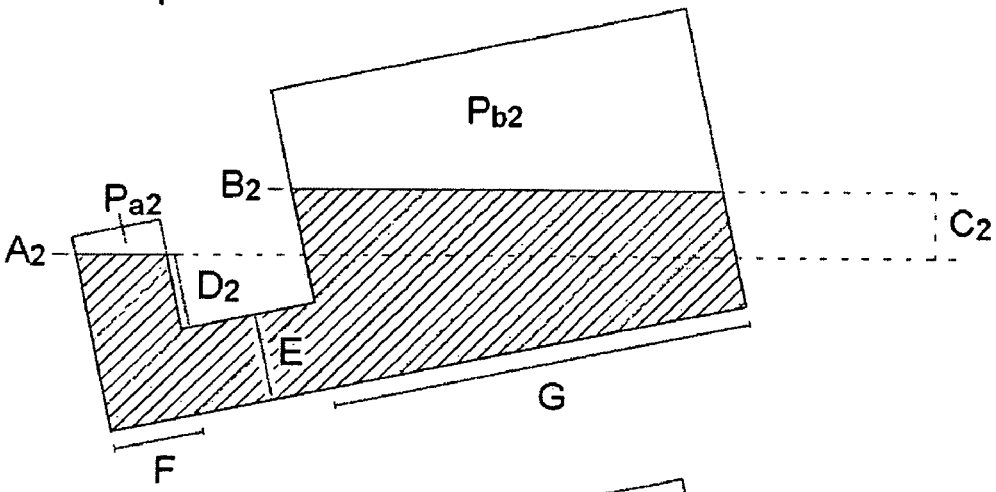
FIG. 8 shows the position of the bottle resting on the forearm while the trigger is activated.

FIG. 8 shows the bottle positioned on the forearm while the trigger is activated.

Under these conditions, the venting hole is opened and the hydrostatic pressure forces the pressure in Pa1 to exchange with outside air until Pa2 is at atmosphere pressure. This results in liquid level A2 to rise while liquid level B2 drops. At this moment Pb2 enters into under pressure.

FIG. 9 shows the bottle positioned on the forearm during triggering of the sprayer and after the trigger has been activated.

Under these conditions, the venting hole is opened and closed. The liquid level A2 drops to A3 because of liquid being taken out by the dip tube. The pressure in Pb2 drops further to Pb3 and air/pressure exchange takes place when liquid level A3 is at level D3. Air and pressure from chamber Pa3 is automatically transferred to chamber Pb3 and liquid flows to the dispensing mechanism. This is a continuous process of chamber Pa and Pb being in balance while the liquid level drops because of emptying the bottle by trigger operation. Exchange of air pressure and liquid is influenced by the shape and dimensions of the conduct and the viscosity of the liquid.

The abbreviations used in the FIGS. 7, 8 and 9 are explained hereafter:

A: liquid level in handle
B: liquid level in container
C: height difference A−B
D: height to conduct
E: cross section conduct
F: handle chamber
G: container chamber
Pa: pressure in chamber F
Pb: pressure in chamber G The shaded area means content e.g. liquid present in the dispenser.

Theoretical diameter of the conduct needed to exchange liquid (water) only:

1.13 mm Ø

This is based on a continuous liquid flow of 1 ml/s, needed to feed liquid to the trigger sprayer.

| | | |
|---|---|---|
| Parameters: | 3.6 kg/hr = | 1 ml/s |
| | 5 cm ΔL = | 0.005 bar (hydrostatic pressure level difference) |
| | Ip = | 1.000 bar (internal pressure) |
| | Up = | 0.995 bar (external pressure) |
| | Δp = | 0.005 bar (pressure difference between internal and external) |

Theoretical diameter of the conduct needed to exchange air only:

0.23 mm Ø

This is based on the above parameters and the following parameters.

| | | |
|---|---|---|
| Parameters: | 3.6 kg/hr = | 3.6 L/hr |
| | 3.6 × 1.29 gr = | 4.644 gr air/hr |

Because of capillary action the minimum diameter of the conduct is:

±2.5 mm Ø to exchange air and liquid via one conduit.

Therefore:

1) the minimum volume of the container body is 100 ml. This is based on smallest reasonable selling item, practically every volume above 1 ml will do.
2) minimum volume of dispenser unit is defined by the shape of the minimum needed handgrip of 2 cm Ø and 4 cm height (12.57 ml)
3) minimum diameter of conduct is then 2.5 mm Ø or 4.9 $mm^2$
4) the dip tube N has preferably a minimum diameter of about 3 mm
5) an alternative for 1 conduct G is to have 2 conducts: one for liquid exchange, another for air exchange, the latter positioned above the liquid level.

FIG. 15 shows an alternative design. As can be easily seen, the handle with the sprayer head is separated from the container body Q. The container body can be filled with liquid via opening F. The dip tube N extends from the sprayer head into the connection between the handle and the container.

Other alternatives will be apparent from FIGS. 16 to 19.

FIG. 20 to 22 show yet another embodiment of the invention. According to this embodiment, the container body Q is connected to the dispensing mechanism by way of a coaxial siphon R.

Such coaxial siphons are well known in the art. They consist of an external chamber R' in which is lodged an internal chamber R" the bottom of which is openly connected to the external chamber R'. External chamber R' and internal chamber R" each comprise connection means to conducts, to the atmosphere or to further devices. Here, the external chamber R' is connected (S) to the container body Q, as one single piece. One may nevertheless also provide for a threaded assembly, snap connection or any other type of known connection S. The internal chamber R" consists essentially in a tube fitted in a manner known per se within the external chamber; one end being open into the external chamber, and the other end T being connected to the dispensing mechanism, here a trigger sprayer as already described above. The internal chamber can be glued in the external chamber or fastened to it by any other way known in the art, like a thread assembly, adjusted assembly, snap assembly or similar. Similarly, the end T of the internal chamber is connected to the trigger sprayer as described earlier herein. The dip tube N belonging to the trigger sprayer extends preferably through the internal chamber R" into the external chamber R', through the opening of the internal chamber R" which connects same to the external chamber R'.

Advantageously, the trigger sprayer is inclined versus the internal chamber R"; i.e. the internal chamber R" is inclined versus a sprayer axis Y perpendicular to the longitudinal spray axis X, away from the container body Q. As will be seen from FIGS. 21 and 22 which show the same embodiment in different positions, the advantageous design of the invention dispenser allows for a good separation between liquid to be dispensed and sprayer head, in most positions, hence eliminating or at least significantly reducing the risk of leakage mentioned earlier herein. The suitable inclination will easily be determined by appropriate experimental trials; it has nevertheless been found that for current purposes, an inclination of 10° to 45°, preferably 15° to 30°, is most preferred.

As will easily be apparent, the siphon R may be designed ergonomically in the form of a comfortable grip or handle, and the container body Q may be designed such as to rest on the user's arm, when in use. The same or similar advantages as mentioned above apply here too. This particular embodiment allows for a good distribution of weight on the user's arm, with liquid flowing through the connection S over the user's arm.

All auxiliary means, like filling opening, label application etc., can be provided for as per other embodiments described earlier herein.

The invention claimed is:

1. A mobile dispenser comprising a container (A) for holding a product to be dispensed and a dispensing mechanism (B); wherein a. the container (A) further comprising:

i. a container body (Q) having a bottom (E), and a means for interconnecting said bottom with a side opposite thereto, said container body further including at least one outlet opening (F) arranged in or near the side opposite to said bottom; and b. the dispensing mechanism (B) further comprising:

i. an external chamber (R');

ii. a conduct (G) connecting said container body (Q) to the external chamber (R') so that the product to be dispensed travels freely between the container body (Q) and the external chamber (R') and extending from the outlet opening (F);

iii. a trigger sprayer (H) fixed to the external chamber (R') at a fixing point and further comprising a dip tube (N) for drawing the product to be dispensed from the external chamber (R'); and iv. a neck (K) connecting said trigger sprayer (H) with said conduct (G) whereby said neck (K) and said conduct (G) are linked to said container body (Q) so that said neck (K) and said conduct (G) form a swan-neck or a U-shape extending from said outlet opening (F) so as to form a siphon that exchanges air pressure and the product to be dispensed between the external chamber (R') and the container body (Q) to form an air bubble between the product to be dispersed and the trigger sprayer (H) so that leakage is prevented when the dispenser is inclined for use; and wherein the container body (Q) is shaped to facilitate resting the container body (Q) on the forearm of a mobile user of the dispenser.

2. The dispenser according to claim 1 wherein the container body (Q) has a cylindrical form.

3. The dispenser according to claim 1 wherein the container body (Q) has a cubical form comprising at least four side walls (C, D) interconnecting the bottom (E) with the side opposite thereto.

4. The dispenser according to claim 1 wherein a protrusion (M) is arranged close to the trigger sprayer (H) to receive the end of a dip tube (N) attached to said trigger sprayer.

5. The dispenser according to claim 4 wherein the protrusion (M) extends the conduct (G) arranged in such a manner as to receive the dip tube (N) attached to the sprayer.

6. The dispenser according to claim 4 wherein the protrusion (M) extends the neck (K) arranged in such a manner as to receive the dip tube (N) attached to the sprayer.

7. The dispenser according to claim 4 wherein the protrusion (M) is arranged in the neck (K) in such a manner as to receive the dip tube (N) attached to the sprayer.

8. The dispenser according to any one of claims 3-7 characterized in that the sidewall (C) of said container body (Q) is shaped in such a manner that said sidewall (C) is resting on the forearm of a user.

9. The dispenser according to any one of claims 4-7 wherein the protrusion (M) contains an opening means (P) and a closure means.

10. The dispenser of claim 1 wherein the dispensing mechanism (B) further comprises an internal chamber (R") lodged within and openly connected to the external chamber (R'), the-trigger sprayer (H) being fixed to the internal chamber (R").

11. The dispenser of claim 10 characterized in that the dip tube of the trigger sprayer is lodged in the internal chamber (R") of the coaxial tube, extending into the external chamber (R') of the coaxial tube.

12. The dispenser of claim 10 characterized in that the internal chamber (R") of the coaxial tube is inclined by 10° to 45°, versus a sprayer axis perpendicular to the longitudinal spray axis.

13. The dispenser of any one of claims 10-12 characterized in that the external chamber (R') of the coaxial tube is shaped in the form of a hand grip and the container body is shaped such as to ergonomically rest on the user's forearm.

14. The dispenser according to claim 1 wherein the trigger sprayer (H) comprises a precompression system.

15. The dispenser according to claim 1 wherein said dispensing mechanism carries at least one label displaying content and user information.

16. The dispenser according to claim 1 comprising an opening for filling in its bottom (E) and/or in one or more of its sidewalls (C, D, . . . ) and/or in its side opposite to said bottom.

17. The dispenser according to claim 1, wherein the container body (Q) is operated at a pressure Pb and a liquid level B and the external chamber (R') is operated at a pressure Pa and a liquid level A, Pa being equal to Pb plus a hydrostatic pressure (Ph) from a liquid level difference in B and A (C), and the conduct (G) balancing a pressure between the pressure Pb and the pressure Pa.

18. The dispenser according to claim 1, wherein the air bubble has a pressure Pa that is greater than a pressure Pb in the external chamber (R').

* * * * *